US009103294B2

(12) United States Patent
Sujan et al.

(10) Patent No.: US 9,103,294 B2
(45) Date of Patent: Aug. 11, 2015

(54) FUEL DRIFT ESTIMATION AND COMPENSATION FOR OPERATION OF AN INTERNAL COMBUSTION ENGINE

(71) Applicant: Cummins Inc., Columbus, IN (US)

(72) Inventors: Vivek A. Sujan, Columbus, IN (US); Ashwin Vyas, Columbus, IN (US); Mert Geveci, Albany, NY (US); Axel Otto zur Loye, Columbus, IN (US)

(73) Assignee: Cummins Inc., Columbus, IN (US)

( * ) Notice: Subject to any disclaimer, the term of this patent is extended or adjusted under 35 U.S.C. 154(b) by 385 days.

(21) Appl. No.: 13/652,875

(22) Filed: Oct. 16, 2012

(65) Prior Publication Data

US 2013/0139788 A1 Jun. 6, 2013

Related U.S. Application Data

(60) Provisional application No. 61/566,188, filed on Dec. 2, 2011.

(51) Int. Cl.

| | |
|---|---|
| ***F02D 41/30*** | (2006.01) |
| ***F02D 41/14*** | (2006.01) |
| ***F02D 41/18*** | (2006.01) |
| ***F02D 41/24*** | (2006.01) |

(52) U.S. Cl.

CPC ..... *F02D 41/1495* (2013.01); *F02D 41/182* (2013.01); *F02D 41/2454* (2013.01); *F02D 41/1454* (2013.01)

(58) Field of Classification Search

CPC . F02D 35/0046; F02D 41/04; F02D 41/1454; F02D 41/30; F02D 41/14; F02D 41/1486; F02D 2001/165; F02D 41/1495; F02D 41/2454; F02D 41/182

USPC ..... 123/350, 436; 701/103–105, 109–110

See application file for complete search history.

(56) References Cited

U.S. PATENT DOCUMENTS

| | | | | |
|---|---|---|---|---|
| 4,373,501 | A | 2/1983 | Rado | |
| 5,190,020 | A | 3/1993 | Cho | |
| 6,480,782 | B2 | 11/2002 | Brackney et al. | |
| 6,679,222 | B1 | 1/2004 | Reischl et al. | |
| 7,044,118 | B2 * | 5/2006 | Tonetti et al. | 123/674 |
| 7,069,138 | B2 | 6/2006 | Bohnig et al. | |
| 7,412,966 | B2 | 8/2008 | Lewis et al. | |
| 7,565,236 | B2 | 7/2009 | Turin et al. | |
| 7,594,498 | B2 | 9/2009 | Lewis et al. | |

(Continued)

OTHER PUBLICATIONS

International Application No. PCT/US2012/066607, International Preliminary Report on Patentability, Jun. 3, 2014, 9 pages.

(Continued)

*Primary Examiner* — Hai Huynh

(74) *Attorney, Agent, or Firm* — Taft Stettinius & Hollister LLP

(57) ABSTRACT

Methods and systems are disclosed for fuel drift estimation and compensation using exhaust oxygen levels and fresh air flow measurements. An actual fueling to the engine cylinders is determined from the exhaust oxygen level and fresh air flow to the internal combustion engine. The actual fueling is compared to an expected fueling based on the fueling command provided to the internal combustion engine. The difference between the actual fueling and expected fueling is fuel drift error attributed to changes or drift in the fuel injection system and is used to correct or compensate future fueling commands for the fuel drift.

20 Claims, 3 Drawing Sheets

(56) References Cited

U.S. PATENT DOCUMENTS

| | | | | |
|---|---|---|---|---|
| 7,640,912 | B2 | 1/2010 | Lewis et al. | |
| 2008/0276906 | A1 | 11/2008 | Thomas | |
| 2009/0320790 | A1 | 12/2009 | Lewis et al. | |
| 2011/0125389 | A1 | 5/2011 | De Fazio et al. | |
| 2013/0054122 | A1* | 2/2013 | Aoyagi | 701/104 |

OTHER PUBLICATIONS

International Search Report and Written Opinion, International Application No. PCT/US2012/066607, Date of Mailing: Feb. 14, 2013, 10 pages.

* cited by examiner

FUEL DRIFT ESTIMATION AND COMPENSATION FOR OPERATION OF AN INTERNAL COMBUSTION ENGINE

CROSS-REFERENCE TO RELATED APPLICATION

This application claims the benefit of the filing date of provisional application No. 61/566,188 filed on Dec. 2, 2011, which is incorporated herein by reference.

BACKGROUND

Fuel injection systems mix fuel with air in an internal combustion engine in response to a fueling command based on, for example, engine speed and torque. The process of determining the necessary amount of fuel, and its delivery into the engine, are known as fuel metering. Early injection systems used mechanical methods to meter fuel. Modern systems are nearly all electronic. An electronic engine control module (ECM) monitors engine operating parameters via various sensors. The ECM interprets these parameters in order to determine the fueling command that provides fueling amount and charge to be injected into the cylinders. The amount of injected fuel depends on conditions such as engine temperature, engine speed and torque.

The three elemental ingredients for combustion in an engine are fuel, air and ignition. To achieve stoichiometry, the fueling for a given set of conditions is estimated using tables based on inputs of engine speed and torque. These tables are calibrated for fuel injectors having certain established operating parameters, such as injection timing and rail pressures. During operation of the engine, the commanded fueling from these tables is selected based on, for example, engine speed and torque, to establish a fueling command in the ECM. The ECM then selects a combustion recipe comprising rail pressure, injector timings, charge references and other elements, which determines an expected fueling and charge into the cylinders from the fuel injectors for a given fueling command. Engine torque and speed are measured and provide feedback for adjusting the fueling command to achieve the desired torque and speed.

Ideally, the actual fueling into the cylinders corresponds to the expected fueling resulting from a fueling command so that engine output torque is known for a given fueling command. However, changes in operating conditions as well as changes and variations in injector performance, variability in the fuel system parts from engine to engine, and other factors can result in actual fueling varying from the expected fueling, otherwise known as fuel drift. Fuel drift causes a torque drift in the engine output and can negatively impact vehicle performance. For example, automatic manual transmissions use torque versus the fueling command models to determine shift patterns. Improper or non-optimal shift patterns may result due to the variation in actual fueling from expected fueling. Fuel economy broadcast accuracy is affected because the fueling command is used to estimate the fuel economy in real time. In addition, emissions increases can occur due to fueling parameter tables being tuned during engine calibration, and fuel drift results in the engine operating at a different point in the engine-fuel-speed map than the point at which the emissions reduction systems were calibrated for a given fueling command.

Thus, there remains a need for further contributions in this area of technology.

SUMMARY

Systems, methods and techniques for fuel drift estimation and compensation for internal combustion engines are disclosed. Other embodiments include unique methods, systems, devices, and apparatus involving fueling an internal combustion engine with a fueling command and performing fuel drift estimation and compensation using exhaust oxygen levels and fresh air flow measurements to determine an actual fueling and comparing the actual fueling to an expected fueling that is based on the fueling command. The difference between the actual fueling and the expected fueling is the fuel drift or fueling drift error. The methods, systems, devices and apparatus may also include compensating in real time for the fueling drift error by modifying subsequent fueling commands based on the fueling drift error so that the actual fueling is more closely aligned with an expected fueling resulting from a fueling command. In one embodiment, modification factors based on the fueling drift error are calculated at various values of commanded fueling, and a modification factor is selected to compensate for fuel drift error at a given commanded fueling. Further embodiments, forms, objects, aspects, benefits, and advantages of the present invention shall become apparent from the figures and description provided herewith.

DETAILED DESCRIPTION OF REPRESENTATIVE EMBODIMENTS

Figure 1:
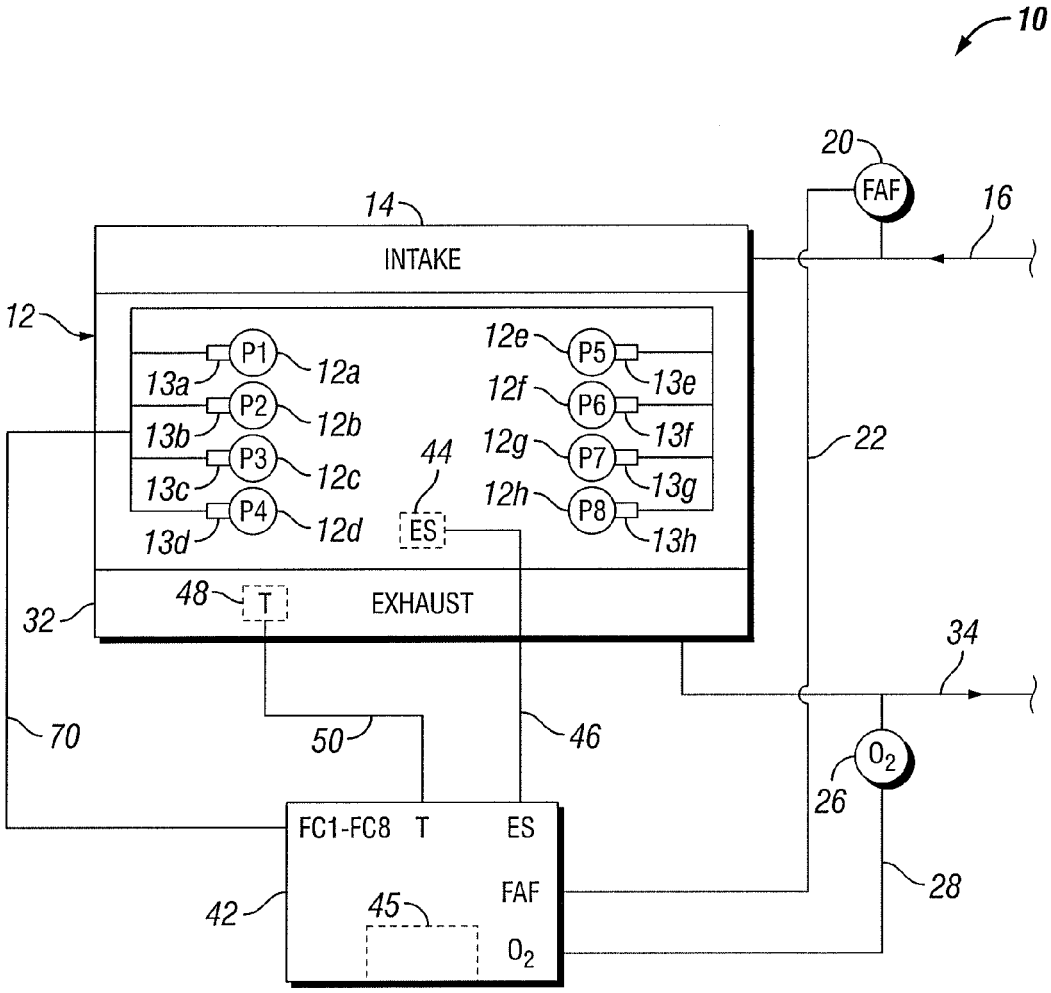
FIG. 1 is a diagrammatic view of an internal combustion engine system including a fuel injection system.

For the purposes of promoting an understanding of the principles of the invention, reference will now be made to the embodiments illustrated in the drawings and specific language will be used to describe the same. It will nevertheless be understood that no limitation of the scope of the invention is thereby intended. Any alterations and further modifications in the described embodiments, and any further applications of the principles of the invention as described herein are contemplated as would normally occur to one skilled in the art to which the invention relates.

Methods and systems are disclosed for estimating and compensating for fuel drift of a fuel injection system in real-time using, for example, exhaust oxygen levels and fresh air flow (FAF) measurements during operation of an internal combustion engine. These measurements are a function of actual fueling into the cylinder from the fuel injection system. Determinations of exhaust oxygen levels and FAF to the engine can be used to estimate or determine actual fueling into the cylinders. The actual fueling is then compared to a predetermined, expected fueling resulting from a fueling command to the fuel injectors derived from, for example, look up tables or tabulated values according to engine speed and torque. The difference between the expected fueling and the actual fueling is fuel drift or fueling drift error. The method and systems may also or alternatively include establishing modification factors based on the fueling drift error to correct or compensate the commanded fueling values defined in the look up tables or tabulated values in real time so that during engine operation subsequent actual fueling is more closely aligned with expected fueling for a given fueling command. The methods and systems disclosed herein can be used for diagnostic and/or operational purposes.

Actual fueling estimates using exhaust oxygen level and FAF measurements may also be used to compensate for fuel drift by modifying the fueling command to adjust the expected fueling that will occur by operation of the fuel injection system. In one embodiment, the method and system determines modification factors at various values of commanded fueling based on an estimate of actual fueling, and updates a table of modification factors to be applied to commanded fueling that is based on, for example, engine speed and torque. The modification factor table may be used to compensate for fuel drift error at a given commanded fueling so that actual fueling more closely aligns with expected fueling for various fueling commands.

The required amount of fueling for a particular air mass may be estimated using look up tables based on engine speed and torque inputs. Such tables may be initially tuned during engine and fuel injector calibration. Typically, this tuning is conducted for fuel injectors having a specified number hours of use since the mean value of fueling for given injector timing and rail pressure initially varies but stabilizes over time. For example, the mean fueling value may stabilize at around 500 hours of fuel injector use. Fuel drift or fueling drift error occurs when there is a difference between the actual fueling and the expected fueling for a given fueling command due to variance in performance of the fuel injection system over time from its initial calibration. In order to compensate for fuel drift or fueling drift error during engine operation, the method and system disclosed herein is operable to estimate fuel drift during engine operation, which can also be used for diagnostic purposes, and to establish compensation factors to apply to the commanded fueling values in the look up tables to correlate the expected fueling associated with the fueling commands with the actual fueling that results when the fueling commands are applied during engine operation.

A reliable estimate of actual fueling in the engine cylinder can be determined under certain operating conditions by measuring the amount or levels of oxygen in the exhaust gas and the fresh air flow into the cylinders. With these values, a combustion equation that relates the exhaust oxygen levels to the amount of fresh air flow can be employed to determine an estimate of actual fueling by the fuel injection system. Thus, by using the combustion equation in Equation 1 below, actual fueling in the cylinder may be estimated using exhaust oxygen and FAF measurements (see Equation 3).

$$\varepsilon\varphi CH_y + (O_2 + \psi N_2) \mapsto \varepsilon\varphi CO_2 + 2(1-\varepsilon)\varphi H_2O + (1-\varphi)O_2 + \psi N_2 \quad (1)$$

$$O_2(\%) = 100 \times \frac{1-\varphi}{(1-\varepsilon)\varphi + 1 + \psi} \quad (2)$$

where $$\varepsilon = \frac{4}{4 + y(1.8 \text{ for \#2 diesel})}$$

$$\psi = 3.773$$

$$\varphi = \frac{1}{\lambda} = \frac{(A/F)_s}{(A/F)} = \frac{14.5(\text{for \#2 diesel})}{A/F} = \frac{14.5\dot{m}_f}{\dot{m}_a}$$

$\dot{m}_f$ = Actual Total Fueling $\dot{m}_a$ = Fresh Air Flow ($FAF$)

By inverting the exhaust $O_2$ (%) relationship, actual fueling can be estimated as follows:

$$\dot{m}_f = \frac{\dot{m}_a}{14.5} \times \frac{1-(O_2/100)(1+\psi)}{1+(O_2/100)(1-\varepsilon)} \quad (3)$$

The calculated actual fueling that occurred for a given fueling command can then be compared to the expected fueling for the fueling command to provide an estimate of the fuel drift or fueling drift error. This fuel drift error estimate can then be used to update in real time fueling command values in the look up tables or tabulated values stored in the ECM or other suitable location within the vehicle systems. The ECM subsequently employs the updated fueling commands in response to driver demand to control operation of the fuel injection system.

FIG. 1 shows an embodiment of an internal combustion engine system 10. System 10 includes an internal combustion engine 12 having an intake manifold 14 fluidly coupled to an intake system 16. Intake system 16 provides an air flow to intake 12. The air flow includes fresh air, and may also include recirculated exhaust gas from an exhaust gas recirculation system (not shown.) The intake air flow may also be pressurized by a compressor of a turbocharger system (not shown). System 10 also includes an exhaust manifold 32 and exhaust system 34 that receives exhaust gases from engine 12. Exhaust system 34 may also be connected to the exhaust gas recirculation system to recirculate exhaust gas to intake system 16, a turbocharger system, and/or aftertreatment devices (not shown) positioned upstream of an outlet that emits exhaust gases to the environment.

Engine 12 can be of any type, and is a diesel engine in one particular embodiment. For the depicted embodiment, engine 12 is of a reciprocating piston type with four stroke operation, and runs on diesel fuel received by direct or port injection with compression ignition. More specifically, as schematically represented in FIG. 1, engine 12 includes, for purposes of illustration and not limitation, eight pistons P1-P8 that are disposed in cylinders 12*a*-12*h*, respectively. Pistons P1-P8 are each connected to a crankshaft by a corresponding connecting rod (not shown) to reciprocally move within the respective cylinder 12*a*-12*h* in a standard manner for four stroke engine operation. Each cylinder 12*a*-12*h* includes a combustion chamber with appropriate intake and exhaust valves (not shown) that are opened and closed via a camshaft (not shown) and fuel injectors 13*a*-13*h*, respectively. Fuel injectors 13*a*-13*h* can be of any type that operate in response to signals from electronic controls described in greater detail hereinafter. Fuel injectors 13*a*-13*h* receive fuel from a fuel source (not shown) in fluid communication therewith. Alternatively or additionally, in other embodiments, engine 12 may operate with a different type of fuel, have a different number of cylinders, and/or otherwise differ from the illustrated embodiment as would occur to those skilled in the art.

System 10 includes a controller 42 that is generally operable to control and manage operational aspects of engine 12. Controller 42 includes memory 45 as well as a number of inputs and outputs for interfacing with various sensors and systems coupled to engine 12 and other components of system 10. Controller 42 can be an electronic circuit comprised of one or more components, including digital circuitry, analog circuitry, or both. Controller 42 may be a software and/or firmware programmable type; a hardwired, dedicated state machine; or a combination of these. In one embodiment, controller 42 is of a programmable microcontroller solid-state integrated circuit type that includes memory 45 and one or more central processing units. Memory 45 can be comprised of one or more components and can be of any volatile or nonvolatile type, including the solid-state variety, the optical media variety, the magnetic variety, a combination of these, or such different arrangement as would occur to those skilled in the art. Controller 42 can include signal conditioners, signal format converters (such as analog-to-digital and digital-to-analog converters), limiters, clamps, filters, and the like as needed to perform various control and regulation operations described herein. Controller 42, in one embodiment, may be a standard type sometimes referred to as an electronic or engine control module (ECM), electronic or engine control unit (ECU) or the like, that is directed to the regulation and control of overall engine operation. Alternatively, controller 42 may be dedicated to control of just the operations described herein or to a subset of controlled aspects of engine 12. In any case, controller 42 preferably includes one or more control algorithms defined by operating logic in the form of software instructions, hardware instructions, dedicated hardware, or the like. These algorithms will be described in greater detail hereinafter, for controlling operation of various aspects of system 10.

Controller 42 includes a number of inputs for receiving signals from various sensors or sensing systems associated with elements of system 10. While various sensor and sensor inputs are discussed herein, it should be understood that other sensor and sensor inputs are possible. Furthermore, one or more sensors and sensor inputs discussed herein may not be required. The operative interconnections of controller 42 and elements of system 10 may be implemented in a variety of forms, for example, through input/output interfaces coupled via wiring harnesses, a datalink, a hardwire or wireless network and/or a lookup from a memory location. In other instances all or a portion of the operative interconnection between controller 42 and an element of system 10 may be virtual. For example, a virtual input indicative of an operating parameter may be provided by a model implemented by controller 42 or by another controller which models an operating parameter based upon other information.

System 10 includes an engine speed sensor 44 electrically connected to an engine speed input, ES, of controller 42 via signal path 46. Engine speed sensor 44 is operable to sense rotational speed of the engine 12 and produce an engine speed signal on signal path 46 indicative of engine rotational speed. In one embodiment, sensor 44 is a Hall effect sensor operable to determine engine speed by sensing passage thereby of a number of equi-angularly spaced teeth formed on a gear or tone wheel. Alternatively, engine speed sensor 44 may be any other known sensor operable as just described including, but not limited to, a variable reductance sensor or the like. In certain embodiments, system 10 includes an engine position sensor (not shown) that detects a current position of the crankshaft.

A flow meter 20, such as mass airflow sensor, can be disposed in intake system 16 to provide a measurement of fresh air flow to intake 14. Flow meter 20 is located upstream of any pressure source, such as a compressor, that may be disposed in intake system 16. In certain embodiments, it is contemplated that the flow meter 20 can be a vane type air flow meter, a hot wire air flow meter, or any other flow meter 20 through which a mass air flow can be determined. Flow meter 20 is connected to controller 42 and operable to produce a fresh air flow rate signal on signal path 22 indicative of the fresh air flow rate. Furthermore, it is contemplated that the fresh air flow rate can be determined virtually, such as, for example, determining the air flow rate using the measured engine speed, combined with a known volumetric efficiency, intake manifold pressure, and intake manifold temperature.

System 10 also includes an oxygen sensor 26 in exhaust system 34 to provide a measurement of the level or amount of oxygen in the exhaust gas from engine 12. Oxygen sensor 26 may be a true oxygen sensor, or any type of sensor from which the oxygen level in the exhaust gas can be determined. Oxygen sensor 26 is connected to controller 42 and operable to produce an oxygen level signal on signal path 28 indicative of the oxygen level in the exhaust gas.

System 10 further includes a temperature sensor 48 disposed in fluid communication with the exhaust manifold intake manifold 32 of engine 12, and electrically connected to an temperature input (T) of controller 42 via signal path 50. Temperature sensors may alternatively or additionally be provided on the intake manifold 14, or other suitable location(s), for determining engine operating temperature. Temperature sensor 48 may be of known construction, and is operable to produce a temperature signal on signal path 50 indicative of the operating temperature of engine 12.

Controller 42 includes a separate output FC1 through FC8 (also collectively designed fuel command outputs FC) to control operation of each fuel injector 13*a*-13*h*, respectively. The signal paths for outputs FC are also collectively designated by reference numeral 70 in FIG. 1; however, it should be understood that the timing of fuel injected by each injector 13*a*-13*h* can be independently controlled for each piston P1-P8 with controller 42. In addition to the timing of fuel injection, controller 42 can also regulate the amount of fuel injected. Typically, fuel amount varies with the number and duration of injector-activating pulses provided to injectors 13*a*-13*h*. Furthermore, controller 42 can direct the withholding of fuel from one or more cylinders 12*a*-12*h* (and pistons P1-P8) for a desired period of time.

For a nominal combustion mode of operation of cylinders 12*a*-12*h*, controller 42 determines a fueling command that provides an appropriate amount of fueling as a function of the engine speed signal ES from engine speed sensor 44 as well as one or more other parameters such as engine load or torque; and generating corresponding fueling command output signals FC, with appropriate timing relative to ignition, using techniques known to those skilled in the art. Controller 42 also executes logic to regulate various other aspects of engine operation based on the various sensor inputs available, and to generate corresponding control signals with output FC, or one or more others (not shown).

Figure 2:
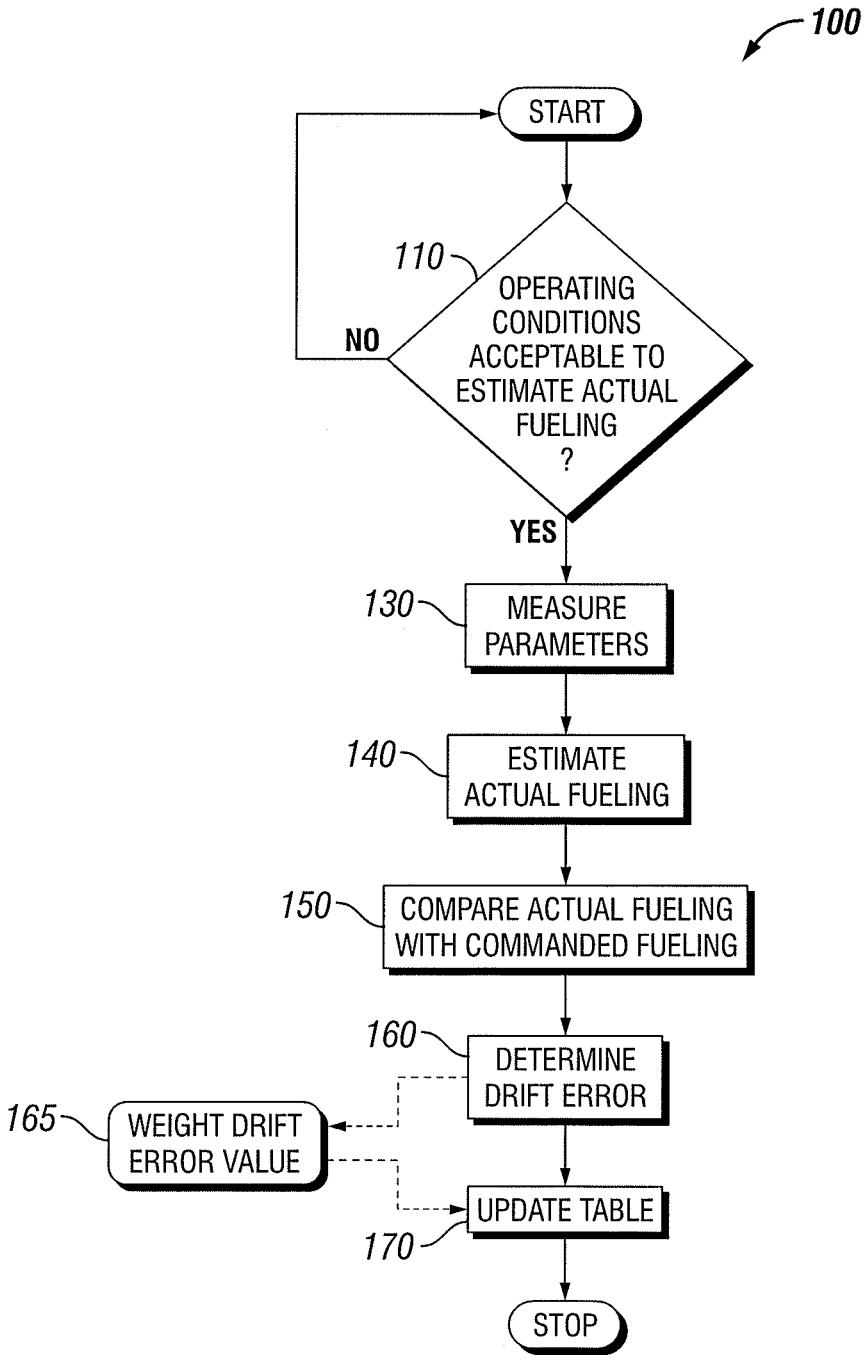
FIG. 2 is a schematic flow diagram of a procedure for estimating and compensating for fuel drift.

FIG. 2 illustrates a fuel drift estimation and compensation procedure 100 in flowchart form, which can be implemented with system 10 using appropriate operating logic executed by controller 42. Procedure 100 is directed to operating engine 12 to determine and compensate for fuel drift in real time so that actual fueling from injectors 13*a*-13*h* is more closely aligned with an expected fueling resulting from a fueling command. The schematic flow diagram and related description which follows provides an illustrative embodiment of performing procedures for estimating and compensating for fuel drift error to improve efficiency and control of the engine operation. Operations illustrated are understood to be exemplary only, and operations may be combined or divided, and added or removed, as well as re-ordered in whole or part. Certain operations illustrated may be implemented by a computer executing a computer program product on a computer readable medium, where the computer program product comprises instructions causing the computer to execute one or more of the operations, or to issue commands to other devices to execute one or more of the operations.

Procedure 100 determines at conditional 110 whether engine operating conditions are acceptable to estimate an actual fueling by measuring oxygen levels in the exhaust and fresh air flow to the engine cylinders. At certain operating conditions, errors in the exhaust oxygen level sensor may be too great to provide a reliable estimate of actual fueling according to combustion equation set forth above. Conditional 110 enables drift error determination to be conducted under conditions which minimize the error in the estimate of actual fueling based on the exhaust oxygen levels and fresh air flow levels. For example, error in the estimate of fuel drift due to inaccuracies in measurements made be oxygen sensors may be amplified at conditions which result in high levels of exhaust oxygen, which typically occur during low fueling conditions during engine operation. In one specific example, oxygen levels in excess of 15% may be considered too high to provide a reliable estimate of actual fueling, although other thresholds are contemplated. At conditional 110, procedure 100 may also consider whether oxygen levels are changing during operation of the engine. Thus, one operating parameter or condition relating to determination of fuel drift may be to limit such determinations to occur, or to only consider determinations that are made, or to appropriately weight determinations that are made, under steady-state operation of system 10.

Once it is determined at conditional 110 that operating conditions are acceptable to estimate actual fueling, procedure 100 continues at operation 130 where engine operating parameters to estimate actual fueling are determined. These parameters may include but are not limited to exhaust oxygen level, fresh air flow to the engine, engine speed, and temperature. Procedure 100 continues at operation 140 where the parameters determined from operation 130 are used to estimate actual fueling using the combustion equations set forth above.

Operation 150 of procedure 100 compares the estimated actual fueling determined in operation 140 with the expected fueling from the fueling command over the same time period. The fueling command is determined from, for example, look up tables or a tabulated set of values stored in memory 45 of controller 42 based on engine speed and torque request from the vehicle operator. Procedure 100 continues at operation 160 and calculates a fuel drift or fueling drift error based on the comparison made in operation 150. The fuel drift may be weighted to account for confidence levels associated with potential errors in the determination of oxygen levels and FAF.

Procedure 100 continues at operation 170 where the fuel drift, whether weighted or not, is applied to update a fueling factor modification table. The fueling factor modification table may be used under multiple engine operating conditions to compensate the fueling command values in the look up tables or tabulated values to account for drift error so that expected fueling associated with the fueling commands are subsequently more aligned with actual fueling provided by the fuel injection system. The look up table or tabulated set of values can be referenced by utilizing a nearest value, an interpolated value, an extrapolated value, and/or a limited value at the end points of the table or tabulated values. The look up table or tabulated set of values may, additionally or alternatively, be referenced by any other operations understood in the art. In still another embodiment, the fuel drift compensation factor is calculated and applied during real time operation to modify the commanded fueling.

In one alternative embodiment, procedure 100 includes an operation 165 that determines a weight factor for the error calculation in accordance with the confidence levels in the oxygen level and fresh air flow-based measurements used in the estimate of actual fueling. Error in estimating the actual fueling may be primarily a function of error in the oxygen sensor measurement capability, and the sensitivity of the error in the actual fueling estimate to oxygen sensor error is a nonlinear function of exhaust oxygen levels. Since the error increases as the amount or level of oxygen in the exhaust increases, for engine operating conditions with low exhaust oxygen levels that occur at operating conditions with high fueling rates, the error in the actual fueling estimate is less than during operating conditions with low fueling rates. Accordingly, the weight factor can account for the fueling rates and provide a greater weight to fuel drift determinations made during operating conditions with low fueling rates.

Figure 3:
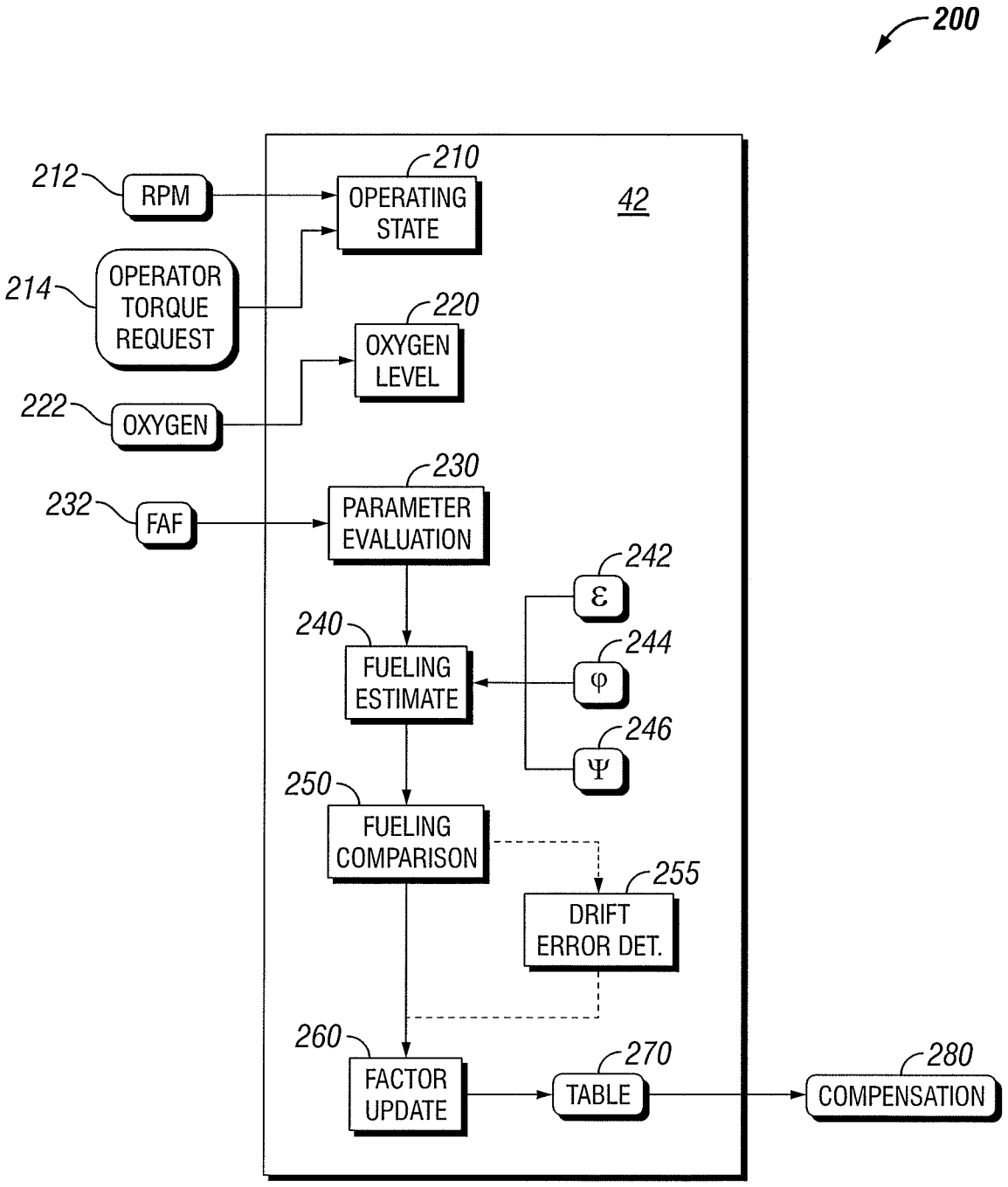
FIG. 3 is a schematic view of a control system that functionally executes certain operations for estimating and compensating for fuel drift.

FIG. 3 is a schematic view illustrating an exemplary control system 200 for estimating and compensating for fuel drift using oxygen level and FAF measurements. In certain embodiments, the system 200 further includes controller 42 structured to perform certain operations for fuel drift determination and correction of fueling commands to account for fuel drift. In certain embodiments, the controller 42 includes one or more modules structured to functionally execute the operations of the controller 42. In certain embodiments, the controller 42 includes an operating state module 210 that interprets an operator request and a current operating condition; an oxygen level determination module 220; a parameter evaluation module 230 for receiving and interpreting inputs from parameter sensors; an estimated actual fueling module 240; a fueling comparison module 250 for comparing estimated actual fueling with commanded fueling; a fuel drift error determination module 255 for determining and weighting potential errors in determining fuel drift; and a factor update module to update compensation or correction factors to be applied to fueling command values stored in table 270.

The description herein including modules emphasizes the structural independence of the aspects of the controller, and illustrates one grouping of operations and responsibilities of the controller. Other groupings that execute similar overall operations are understood within the scope of the present application. Modules may be implemented in hardware and/or software on computer readable medium, and modules may be distributed across various hardware or software components. More specific descriptions of certain embodiments of controller operations are included in the section referencing FIG. 3. Certain operations described herein include interpreting or determining one or more parameters, which includes receiving values by any method known in the art, including at least receiving values from a datalink or network communication, receiving an electronic signal (e.g. a voltage, frequency, current, or PWM signal) indicative of the value, receiving a software parameter indicative of the value, reading the value from a memory location on a computer readable medium, receiving the value as a run-time parameter by any means known in the art, and/or by receiving a value by which the parameter can be calculated, and/or by referencing a default value that is the parameter value.

In operation, operating state module 210 and oxygen level module 220 determine acceptable conditions for estimating an actual fueling to the engine cylinder. Operating state module 210 receives inputs such as engine speed 212 and operator torque request 214. Other inputs are also contemplated, such as engine operating temperature. Oxygen level module 220 receives inputs such as the level of oxygen in the exhaust gas. Modules 210 and 220 may consider other parameters to determine appropriate operating conditions.

Modules 210 and 220 operate to determine whether an acceptable operating condition exists in which to determine fuel drift. This determination considers the sensitivity of the actual fueling estimate to current engine operating conditions. Determination of fuel drift error can be enabled when the error in determining the fuel drift using oxygen and FAF measurements is minimized. For example, error in estimating actual fueling can be high in operating conditions where the oxygen level in the exhaust gas is high. Therefore, conditions in which oxygen levels in the exhaust are low and in which the oxygen level readings in the exhaust are steady are ideal for determining drift error using estimated actual fueling from oxygen and FAF measurements during engine operation. One example of a suitable operating condition for estimating actual fueling is a steady state operation of the engine with levels of oxygen less than 15% to avoid low fueling conditions and transient conditions where oxygen level measurements may provide a poorer estimate of actual fueling.

Parameter evaluation module 230 receives and evaluates engine operation parameters to be applied to further calculations. Such parameters may include but are not limited to oxygen level 222, FAF 232 and engine fuel type. Fueling estimate module 240 determines an estimate of actual fueling based on a combustion equation relating variables such as those established by sensed parameters 222, 232 and stored values 242, 244, 246 to an estimated actual fueling. The estimated actual fueling calculated in module 240 is compared to a commanded fueling in fueling comparison module 250. Fuel drift error determination module 255 determines a fuel drift or fueling drift error based on the comparison. An error value associated with the fuel drift may be determined in drift error determination module 255 based on confidence in the actual fueling estimate in view of the engine operating parameters and sensed oxygen and FAF levels. Factor update module 260 updates a modification factor table 270 or tabulated set of values stored in controller 205 that are applied to fueling commands for given engine speed and torque values to determine a compensated commanded fueling 280. Compensated fueling command 280 provides a fueling command that more closely aligns the expected fueling resulting from the fueling command with the actual fueling estimated in the drift error determination.

Increased fuel economy, enhanced vehicle performance, and improved control of emissions can be achieved with the methods and systems disclosed herein for estimating and compensating for fuel drift in real time during engine operation. According to one aspect, a method comprises determining an engine operating state to be suitable for a fuel drift determination; determining an oxygen level in an exhaust gas and a fresh air flow while in the engine operating state; determining an estimated actual fueling as a function of the oxygen level and the fresh air flow; comparing the estimated actual fueling to a fueling command in the operating state; and determining a fuel drift as a result of the comparison of the estimated actual fueling to the fueling command.

In one refinement of the method, the drift error is used to establish a correction factor and the correction factor is used to update the fueling commands for various engine speed and torque values. In a further refinement of the method, the updated fueling commands are used to control fuel injector operation for during any subsequent engine operating state.

According to another aspect, a system comprises an internal combustion engine having a fuel injection system; an exhaust oxygen sensor in an exhaust connected to the internal combustion engine; a fresh air flow sensor for sensing fresh air flow to the internal combustion engine; and a controller connected to the fuel injection system, the engine, and the exhaust and fresh air flow sensors. The controller is operable to determine an engine operating state to be suitable for a fuel drift determination; determine an oxygen level in an exhaust gas and a fresh air flow while in the engine operating state; determine an estimated actual fueling as a function of the oxygen level and the fresh air flow; compare the estimated actual fueling to a fueling command in the operating state; and determine a fuel drift as a result of the comparison of the estimated actual fueling to the fueling command.

In one refinement of the system, the controller is operable to use the drift error to establish a correction factor and update the fueling commands for various engine speed and torque values stored in a memory of the controller. In a further refinement of the system, the controller uses the updated fueling commands corrected for fuel drift to control fuel injector operation during any subsequent operating state of the engine.

According to another aspect, a method includes: determining an oxygen amount in an exhaust gas and a fresh air flow to an internal combustion engine while fueling the internal combustion engine with a first fueling command that is based on a desired engine speed and torque; while fueling with the first fueling command, determining an actual fueling to the internal combustion engine as a function of the oxygen amount and the fresh air flow; comparing the actual fueling to an expected fueling, wherein the expected fueling is predetermined and based on the first fueling command; and determining a fuel drift from the comparison of the actual fueling to the expected fueling.

In one refinement of the method, after determining the fuel drift, the method includes providing a second fueling command that corresponds to the desired engine speed and torque, and the second fueling command is corrected for the fuel drift to more closely align the expected fueling associated with the second fueling command with the actual fueling. In one embodiment, the second fueling command is corrected by a correction factor that is selected from a table of correction factors, and the table of correction factors corrects a corresponding table of fueling commands for the fuel drift. In another embodiment, the second fueling command is used for subsequent operation of the internal combustion engine.

In another refinement, the method includes determining the oxygen amount in the exhaust is less than a predetermined threshold before determining the fuel drift. In one embodiment, the predetermined threshold is 15%. In another refinement, the method includes determining the internal combustion engine is in a steady state of operation before determining the fuel drift.

According to another aspect, a system comprises an internal combustion engine having a fuel injection system configured to provide an expected fueling to the internal combustion engine in response to a fueling command, a sensor in an exhaust system connected to the internal combustion engine for determining an oxygen level in exhaust gases emitted from the internal combustion engine, a fresh air flow sensor for measuring a fresh air flow to the internal combustion engine, and a controller connected to the fuel injection system, the engine, the sensor in the exhaust system, and the fresh air flow sensor. The controller is configured to determine an actual fueling to the internal combustion engine as a function of the oxygen level in the exhaust gases and the fresh air flow to the internal combustion engine, compare the actual fueling to the expected fueling, and determine a fuel drift from a comparison of the actual fueling to the expected fueling.

In one refinement of the system, in response to the fuel drift the controller is configured to provide a second fueling command that corresponds to the desired engine speed and torque, and the second fueling command is corrected to more closely align the expected fueling with the actual fueling. In one embodiment, the controller is configured to correct the second fueling command by selecting a correction factor from a table of correction factors, and the table of correction factors corrects a corresponding table of fueling commands for the fuel drift. In another embodiment, before determining the fuel drift, the controller is configured to determine that the oxygen level in the exhaust gases is less than a predetermined threshold.

In another refinement of the system, the controller is configured to determine the internal combustion engine is in a steady state of operation before determining the fuel drift. In one refinement, the internal combustion engine is a diesel engine. In another refinement of the system, the fresh air flow sensor is a mass air flow sensor. In yet another refinement of the system, the sensor in the exhaust system is an oxygen sensor.

According to another aspect, a method includes: determining an oxygen level in an exhaust gas from and a fresh air flow to an internal combustion engine while fueling the internal combustion engine with a fueling command that provides an expected fueling to satisfy an engine speed and a torque request; determining a fueling drift error from the difference between an actual fueling to the internal combustion engine and the expected fueling to the internal combustion engine based on the fueling command, wherein the actual fueling is determined as a function of the oxygen level and the fresh air flow; and modifying the fueling command in response to the fueling drift error to reduce the difference between the expected fueling and the actual fueling In one refinement, the method includes determining the oxygen amount in the exhaust is less than a predetermined threshold before determining the fuel drift. In another refinement, the method includes determining the internal combustion engine is in a steady state of operation before determining the fuel drift.

Any theory, mechanism of operation, proof, or finding stated herein is meant to further enhance understanding of the present invention and is not intended to make the present invention in any way dependent upon such theory, mechanism of operation, proof, or finding. It should be understood that while the use of the word preferable, preferably or preferred in the description above indicates that the feature so described may be more desirable, it nonetheless may not be necessary and embodiments lacking the same may be contemplated as within the scope of the invention, that scope being defined by the claims that follow. In reading the claims it is intended that when words such as "a," "an," "at least one," "at least a portion" are used there is no intention to limit the claim to only one item unless specifically stated to the contrary in the claim. Further, when the language "at least a portion" and/or "a portion" is used the item may include a portion and/or the entire item unless specifically stated to the contrary. While the invention has been illustrated and described in detail in the drawings and foregoing description, the same is to be considered as illustrative and not restrictive in character, it being understood that only the selected embodiments have been shown and described and that all changes, modifications and equivalents that come within the spirit of the invention as defined herein are desired to be protected.

What is claimed is:

1. A method, comprising:

determining an oxygen amount in an exhaust gas and a fresh air flow to an internal combustion engine while fueling the internal combustion engine with a first fueling command that is based on a desired engine speed and torque;

while fueling with the first fueling command, determining an actual fueling to the internal combustion engine as a function of the oxygen amount and the fresh air flow;

comparing the actual fueling to an expected fueling, wherein the expected fueling is predetermined and based on the first fueling command;

determining the oxygen amount in the exhaust gas is less than a predetermined threshold; and in response to the oxygen amount being less than the predetermined threshold, determining a fuel drift from the comparison of the actual fueling to the expected fueling.

2. The method of claim 1, wherein after determining the fuel drift, further comprising providing a second fueling command that corresponds to the desired engine speed and torque, wherein the second fueling command is corrected for the fuel drift to more closely align the expected fueling associated with the second fueling command with the actual fueling.

3. The method of claim 2, wherein the second fueling command is corrected by a correction factor that is selected from a table of correction factors, wherein the table of correction factors corrects a corresponding table of fueling commands for the fuel drift.

4. The method of claim 2, wherein the second fueling command is used for subsequent operation of the internal combustion engine.

5. The method of claim 1, wherein the predetermined threshold is 15%.

6. The method of claim 1, further comprising determining the internal combustion engine is in a steady state of operation before determining the fuel drift.

7. The method of claim 1, wherein the fresh air flow is determined with a virtual sensor.

8. A system, comprising:

an internal combustion engine having a fuel injection system configured to provide an expected fueling to the internal combustion engine in response to a fueling command;

a sensor in an exhaust system connected to the internal combustion engine for determining an oxygen level in exhaust gases emitted from the internal combustion engine;

a fresh air flow sensor for measuring a fresh air flow to the internal combustion engine;

a controller connected to the fuel injection system, the engine, the sensor in the exhaust system, and the fresh air flow sensor, wherein the controller is configured to:

determine an actual fueling to the internal combustion engine as a function of the oxygen level in the exhaust gases and the fresh air flow to the internal combustion engine;

compare the actual fueling to the expected fueling;

determine that the oxygen level in the exhaust gases is less than a predetermined threshold: and in response to the oxygen level being less than the predetermined threshold, determine a fuel drift from a comparison of the actual fueling to the expected fueling.

9. The system of claim 8, wherein in response to the fuel drift the controller is configured to provide a second fueling command that corresponds to the desired engine speed and torque, wherein the second fueling command is corrected to more closely align the expected fueling with the actual fueling.

10. The system of claim 8, wherein the controller is configured to correct the second fueling command by selecting a correction factor from a table of correction factors, wherein the table of correction factors corrects a corresponding table of fueling commands for the fuel drift.

11. The system of claim 8, wherein the predetermined threshold is 15.

12. The system of claim 8, wherein the controller is configured to determine the internal combustion engine is in a steady state of operation before determining the fuel drift.

13. The system of claim 8, wherein the internal combustion engine is a diesel engine.

14. The system of claim 8, wherein the fresh air flow sensor is a mass air flow sensor.

15. The system of claim 8, wherein the sensor in the exhaust system is an oxygen sensor.

16. The system of claim 8, wherein the fresh air flow sensor is a virtual sensor.

17. A method, comprising:

determining an oxygen level in an exhaust gas from and a fresh air flow to an internal combustion engine while fueling the internal combustion engine with a fueling command that provides an expected fueling to satisfy an engine speed and a torque request;

determining the oxygen level in the exhaust gas is less than a predetermined threshold;

in response to the oxygen level being less than the predetermined threshold and the internal combustion engine being in a steady state of operation, determining a fueling drift error from the difference between an actual fueling to the internal combustion engine and the expected fueling to the internal combustion engine based on the fueling command, wherein the actual fueling is determined as a function of the oxygen level and the fresh air flow; and modifying the fueling command in response to the fueling drift error to reduce the difference between the expected fueling and the actual fueling.

18. The method of claim 17, wherein the predetermined threshold is 15%.

19. The method of claim 17, Wherein modifying the fueling command further includes correcting the fueling command by a correction factor that is selected from a table of correction factors, wherein the table of correction factors corrects a corresponding table of fueling commands for the fuel drift error.

20. The method of claim 17, wherein the fresh air flow to the internal combustion engine is determined by a mass air flow sensor and the oxygen level in the exhaust is determined by an oxygen sensor.

* * * * *